United States Patent [19]

Patel

[11] 3,932,576

[45] Jan. 13, 1976

[54] APPARATUS FOR AND METHOD OF MELT SPINNING

[75] Inventor: Pravin Patel, Columbia, Md.

[73] Assignee: Concorde Fibers, Inc., Columbia, Md.

[22] Filed: Dec. 23, 1974

[21] Appl. No.: 535,459

[52] U.S. Cl. ..... 264/178 F; 425/71
[51] Int. Cl.[2] ..... D01D 3/00; D01D 5/00
[58] Field of Search ..... 425/71; 264/178 F

[56] References Cited

UNITED STATES PATENTS 3,487,144 12/1969 Sarian ..... 425/71 X 3,696,184 10/1972 Arnett et al. ..... 425/71 X

*Primary Examiner*—Robert D. Baldwin
*Attorney, Agent, or Firm*—Nolte and Nolte

[57] ABSTRACT

In melt spinning, in order to permit high rates of spinning without deterioration in yarn quality, the area in which the filaments enter the quench bath is partially surrounded by baffle means and at at least two symmetrical locations about the periphery of that area wetting agent is introduced into the area.

6 Claims, 3 Drawing Figures

APPARATUS FOR AND METHOD OF MELT SPINNING

This invention relates to melt spinning. More particularly, the invention relates to improvements in the apparatus for and method of melt spinning to permit higher rates of production without deterioration, and even improvement, of yarn quality.

In melt spinning, when a plurality of molten filament streams is extruded through a spinneret into a quench bath, problems relating to interaction between the filaments and the aqueous quench liquid occur, particularly as production rates are increased. Turbulence in or vortexing of the quench liquid can create irregularities in the filaments and even bring the filaments into contact with each other while they are tacky and thereby cause the occurrence of filament damage and loss of production time. In attempts to alleviate such problems, it has not been uncommon to surround with baffle means the area of the quench liquid at which the filaments enter the quench bath. The baffles may be foraminous to permit controlled circulation of quench liquid between the enclosed zone and the surrounding remainder of the bath. It is also known to incorporate wetting agents into the quench liquid as an additional attempt to minimize such interaction between the quench liquid and the filaments as would tend to damage the filaments and cause loss of production time. Wetting agent lowers the surface tension of the water whereupon the water contained between adjacent filaments is less likely to pull the filaments together. Pulling together of the filaments at this stage is harmful because the filaments are still tacky and will tend to adhere to each other when brought into contact. Wetting agent also reduces the friction between the surface of the filaments and the quench liquid. In the absence of adequate distribution of wetting agent, at higher levels of production, turbulence is created at the interface of the filament surfaces and the quench liquid, resulting in the acquisition by the filaments of undesired bumpy surfaces because the filaments are still deformable at this stage.

U.S. Pat. No. 3,696,184 discloses for a melt spinning quench bath a composite baffle constituted of three concentric, foraminous, hollow cylinders. This baffle was, indeed, an improvement over prior art baffles for this purpose. However, as production rates were increased, it was found that a baffle which entirely surrounded the area at which the filaments entered the quench liquid, including the aforementioned baffle, could contribute to vortexing while reducing random turbulence. Vortexing, like random turbulence, tends to bring the still tacky filaments into contact with each other and, accordingly, is undesirable.

Consideration of this situation led to the conclusion that the filaments were creating a downwardly directed columnar flow of quench liquid and the baffles, though foraminous, were sufficiently impeding the flow of liquid at the surface of the bath toward the zone at which a downward flow of a column of liquid was created that vortexing was produced.

As production rates were increased, proper distribution of wetting agent also became more difficult. The practice was to introduce the wetting agent, through a single feed tube, at the surface of the quench liquid in the area in which the filaments entered the quench liquid. As the incidence of the fusing of adjacent filaments at higher production rates increased, the concept developed that, perhaps, inadequate distribution of the wetting agent was a contributing factor.

According to the present invention, the incidence of fusion of filaments during the melt spinning has been greatly reduced by means of two measures. According to one aspect of the invention, baffle means are provided which only partially surround the area at the surface of the quench liquid at which the molten filaments enter the quench liquid. According to another aspect of the present invention, wetting agent is conducted to the aforementioned area at at least two points at least approximately at the periphery of the area and at least approximately symmetrically located about the area. Vortexing is essentially eliminated while general, random turbulence is still minimized and the wetting agent is uniformly distributed among the filaments. The solution to these problems is simple to state, but was not simple to attain because first it was necessary to comprehend the phenomena contributing to the problem of filaments adhering together.

The invention shall now further be described by reference to the embodiment illustrated in the drawings, in which.

Figure 1:
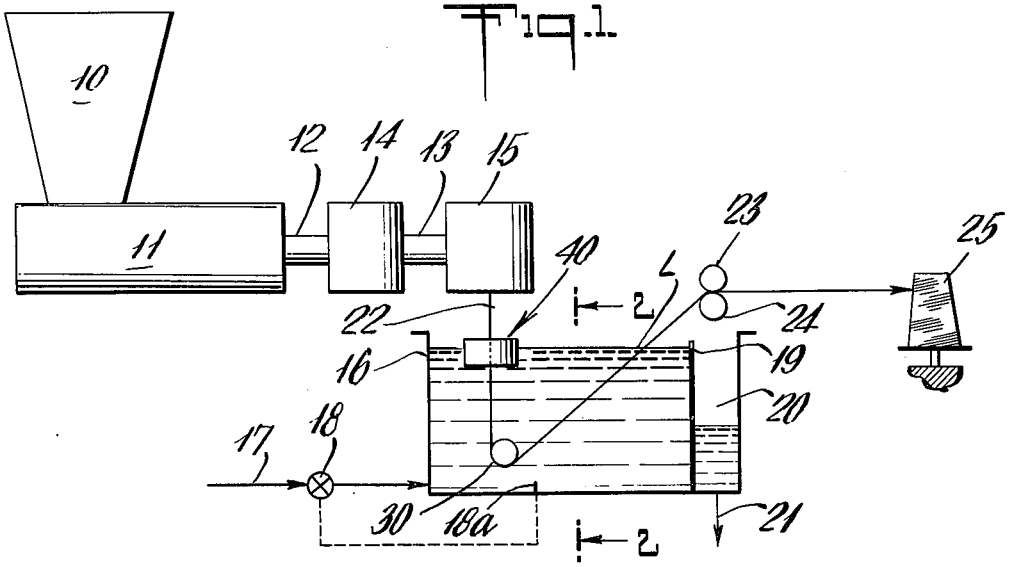
FIG. 1 is a plan view, partly in section, of the general melt spinning apparatus.

Polypropylene pellets and color concentrate pellets, for coloring the yarn to the desired color, are introduced into the hopper 10 of an extruder 11. In the extruder 11, the pellets are converted into a molten, homogeneous mass. The molten mass is conducted from the extruder 11 through conduits 12 and 13, at a rate regulated by a metering pump 14, to a spinning head 15. The spinning head 15 contains the conventional filter packs for filtering out any incidental particulate matter and, superimposed in the flow path of the molten plastic immediately downstream from the filter packs, a spinneret. The spinneret faces the surface of the aqueous quench liquid L, which is contained in a bath or tank 16. To the bottom of the tank 16 is fed water through conduit 17 provided with a solenoid operated valve 18, which is actuated by a thermostat **18*a* located in the tank 16 below the liquid level in the tank. The thermostat 18*a* is set to close the solenoid circuit when the bath temperature decreases to a temperature below a predetermined temperature. The tank 16 is provided with a weir 19 over which the quench liquid L flows into a compartment 20, the bottom of which communicates with a drain 21. When the valve 18 is actuated, the water supply is shut off or slowed down until the quench liquid temperature is increased to the predetermined temperature plus a few tenths of a degree F. Because the water fed through conduit 17** is unheated tap water and because the filaments are at a considerably higher temperature and, therefore, heat the aqueous quench liquid L, the aforementioned scheme regulates the temperature of the aqueous quench liquid L.

Figure 3:
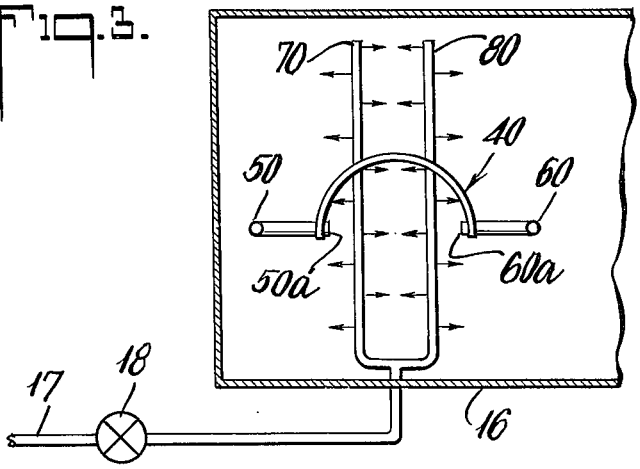
FIG. 3 is a detail taken on section line 3—3 of FIG. 1, showing the semicircular configuration of the baffle, the feed of the wetting agent and the feed of the quench liquid.

The extruded filaments 22, initially in the form of molten streams, enter the quench liquid L wherein solidification to solid filaments takes place. The actual distance between the face of the spinneret and the quench liquid is on the order of an inch or less, and it will, therefore, be appreciated that the drawings are intended to be schematic since the general technology for melt spinning is known and the present invention does not relate to such general technology. Partially surrounding the area at which the filaments enter the quench liquid L is a semicircular baffle 40 (FIGS. 1 and 3). The baffle is not shown in detail here because it is, in fact, one-half of the circular baffle illustrated in detail in U.S. Pat. No. 3,696,194. Toward the bottom of the tank 16, the filaments are conducted around a guide bar 30. The filaments are withdrawn from the tank 16 by means of a pair of driven nip rollers 23, 24. Therefrom, the filaments are led to a winding machine where they are taken up as a yarn package 23. The yarn package 23 is then transferred to a drawing unit (not illustrated) on which the filaments are drawn and thereby oriented.

Figure 2:
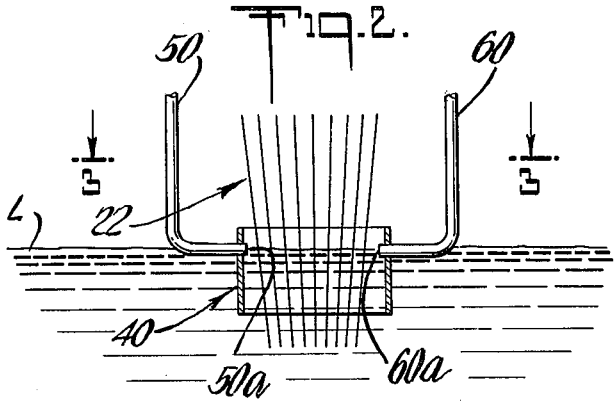
FIG. 2 is a view taken on section line 2—2 of FIG. 1, showing, in particular, the arrangement of the feeding of the wetting agent into the area surrounded by the baffle.

In FIG. 1, for simplicity of illustration, the filaments 22 are denoted by a single line. Moreover, in FIG. 1, because of the limitations of space, the introduction of the wetting agent is not illustrated. However, these matters are attended to in FIG. 2. Here, filaments 22 are shown in plurality entering the surface of the quench liquid L. Conduits 50 and 60 each communicate with a common reservoir (not illustrated) of wetting agent, in this case an aqueous solution of an alkylolamide, and each conduit is provided with a metering pump (not illustrated) for metering the wetting agent through each conduit at the same rate. The conduits have respective outlet openings 50*a* and 60*a* at the surface of the liquid and just within the inner periphery of the baffle 40. The openings 50*a* and 60*a* are angularly displaced from each other by 180°. It will be understood that in the case of the three layer baffle construction of the aforementioned patent, the openings of the respective conduits are just within the innermost layer of the baffle.

FIG. 3 illustrates another detail which is not shown in FIG. 1, in particular, how the quench liquid is distributed once it has been introduced into the tank through the conduit 17. In fact, as seen in FIG. 3, the conduit 17 communicates with two branch conduits 70 and 80 at the vicinity of the bottom of the tank and equidistantly spaced from the axis from the baffle 40 and symmetrically oriented relative to the baffle 40. The branch conduits 70 and 80 each have oppositely directed openings through which the aqueous quench liquid issues. In FIG. 3, this is illustrated by arrows extending from the branch conduits 70 and 80. As part of the effort to minimize turbulence, symmetry is important.

Turning now to even more specific information, the following data pertain to the use of polypropylene. The molten polypropylene is fed by the metering pump 14 to the spinneret 15 at the rate of 183 lbs. per hr., representing an increase of about 30% from a rate production of 150 lbs. per hr. before the present invention. The spinneret is provided with seventy-two orifices.

The efficiency of the operation, that is, the percentage of the time that the line is not shut down because of difficulties with the filaments, was increased from 90% to about 94–95% and the percentage of the yarn which could be classified as first quality was increased from 85% to about 89–90%. Such differences are, in practical terms of production econimics, very significant and very difficult to attain.

What is claimed is:

1. In an apparatus for the melt spinning of a plurality of thermoplastic filaments, the apparatus comprising a vessel for containing a quench liquid and a spinneret arranged above the level to which the vessel is to be filled with the quench liquid so that molten filaments extruded through the spinneret enter the quench liquid wherein the filaments are solidified, the improvement comprising baffle means partially surrounding an area at the surface of the quench liquid at which the molten filaments enter the quench liquid said baffle means surrounding said area sufficiently to essentially eliminate vortexing and minimize random turbulence, and means for conducting a wetting agent to said area, said means comprising conduits having outlets at least approximately at the periphery of said area, the outlets being at least two in number and being at least approximately symmetrically located about said area.

2. In an apparatus according to claim 1, in the improvement in which the baffle means is at least approximately semicircular in a plane parallel to the surface of the quench liquid.

3. In an apparatus according to claim 2, in the improvement in which the number of said outlets is two and said outlets are angularly displaced from each other by about 180°.

4. In a method for the melt spinning of a plurality of thermoplastic filaments, the method comprising extruding molten filaments through a spinneret into a quench liquid located in a vessel below the spinneret wherein the filaments are solidified, the improvement comprising partially surrounding with baffle means an area at the surface of the quench liquid at which the molten filaments enter the quench liquid, said partial surrounding being sufficient to essentially eliminate vortexing and minimize random turbulence, and conducting a wetting agent to said area through conduits having outlets at at least two points at least approximately at the periphery of said area and at least approximately symmetrically located about said area.

5. In a method according to claim 4, in the improvement in which an at least approximately semicircular portion of the periphery of the area is occupied by the baffle means.

6. In a method according to claim 5, in the improvement in which the wetting agent is conducted to two points at least approximately at the periphery of said area and said two points are angularly displaced from each other by about 180°.

* * * * *